United States Patent [19]

Pfenning

[11] Patent Number: 5,052,550

[45] Date of Patent: Oct. 1, 1991

[54] SPECTACLE CASE

[75] Inventor: Wilhelm Pfenning, Baden, Canada

[73] Assignee: Almut G. Pfenning, Baden, Canada; a part interest

[21] Appl. No.: 647,268

[22] Filed: Jan. 29, 1991

[30] Foreign Application Priority Data

Feb. 2, 1990 [CA] Canada ..... 2009254

[51] Int. Cl.[5] ..... A45C 11/04

[52] U.S. Cl. ..... 206/5

[58] Field of Search ..... 206/5, 6

[56] References Cited

U.S. PATENT DOCUMENTS

| | | | |
|---|---|---|---|
| 1,158,170 | 10/1915 | Bradley et al. | 206/5 |
| 2,332,266 | 10/1043 | Segal | 206/6 |
| 2,455,079 | 11/1948 | Mercer | 206/6 |
| 2,650,700 | 9/1953 | Wolf | 206/5 |
| 2,739,698 | 3/1956 | Baratelli | 206/5 |
| 2,762,499 | 9/1956 | Stegeman | 206/5 |
| 2,866,539 | 12/1958 | McCulloch | 206/5 |
| 3,819,033 | 5/1974 | Hueber | 206/5 |
| 3,994,391 | 11/1976 | Holland | 206/6 X |
| 4,863,013 | 9/1989 | Eastman | 206/5 |

*Primary Examiner*—William I. Price

*Attorney, Agent, or Firm*—Anthony Asquith & Co.

[57] ABSTRACT

The spectacle case (20) is of the open-mouth type. The case includes an inner lining (25) of thin cotton, which is stitched top (30) and bottom (36) into a stiff outer cover (23). The stitching is so arranged as to leave the central portion of the lining loose and able to expand and move laterally, within the outer cover. An encircling elastic band (27) creates a pinched waist (40) in the lining. The elastic band tightens the lining around the nose cut-out (43) of spectacles (40) inserted into the case, thereby retaining the spectacles securely.

4 Claims, 2 Drawing Sheets

SPECTACLE CASE

This invention relates to spectacle cases of the kind that are placed in, or clipped to, a shirt pocket, or the like. Such spectacle cases are used for containing reading glasses; and one aspect of the design and operation of the spectacle case is that a person should find no difficulty in quickly extracting the spectacles from, and replacing them in, the case.

BACKGROUND TO THE INVENTION

The invention is concerned with the type of spectacle case which is basically tubular in form, being closed at the bottom end, and having an open mouth at the top end. This type of open-mouth case may be contrasted with the type which comprises a box with a hinged lid.

In the type of spectacle case which comprises a box with a hinged lid, the case can be quite hard and rigid, and such a case offers excellent protection against the spectacles becoming scratched or otherwise damaged because, in this design, the spectacles are not gripped by the case in any way. On the other hand, when the case comprises a box with a hinged lid, it is not practically possible for a person to take the spectacles out of the case unless the person uses both hands.

The type of spectacle case with which the invention is concerned is the kind where the case has an open mouth at the top end, wherein it is possible for a person to insert and extract the spectacles with one hand.

In the conventional open-mouth design, the spectacles remain in the case primarily by the action of gravity. Thus, if the person leans forward, or indulges in vigorous movements, there is a danger that the spectacles might fall out of the case.

The conventional design of open-mouth case is such that whatever grip the case exerts on the spectacles is exerted by way of direct contact between the inside of the case and the glass of the spectacle lens. Because of this, if the contact is at all forceful, the lenses can, with use, and with repeated insertions and extractions of the spectacles, gradually become dulled or scratched.

With the conventional design of open-mouth case, experience has shown that if the case is tight enough upon the spectacles to provide a reasonably secure grip, then the case has to squeeze the spectacles so tightly to achieve the required grip that there is too high a chance that the spectacles may become damaged over time. An associated problem is that of course not all spectacles have the same dimensions, yet inevitably the strength of the case's grip depends on the dimensions of the spectacles.

The problem therefore may be summed up in that it has not proved possible, with the conventional design of open-mouth spectacle case, to provide sufficient grip to hold the spectacles in securely, and yet at the same time to permit the spectacles to be easily inserted into and removed from the case, with one hand, and without damaging the spectacles, over a useful range of sizes of spectacles.

DESCRIPTION OF MAIN FEATURES OF THE INVENTION

In the invention, the spectacle case comprises an outer cover and an inner lining. The outer cover is of tubular form, open at its top end, and closed at its bottom end; the inner lining also is of similar tubular form, open at the top end and closed at the bottom end. The open top end of the inner lining is secured, for example by stitching, to the open top end of the outer cover, and the closed bottom end of the inner lining is secured to the closed bottom end of the outer cover.

The outer cover is of such material and dimensions as to be stiff, so as to provide good physical protection of the spectacles. The inner lining is of such material and dimensions as to have substantially no stiffness.

A central portion of the inner lining is not secured to the outer cover, but rather the central portion is loose and free to float laterally within the outer cover. It is arranged, in the invention, that it is this loose central portion which acts to grip the spectacles, and thus to retain the spectacles within the case.

In the invention, the inner lining is itself well secured, top and bottom, to the outer cover. Since the spectacles are securely gripped within the inner lining, therefore the spectacles are well secured with respect to the case.

The inner lining preferably is arranged with a pinched waist. To achieve this, an elastic band may be stitched around the loose central portion of the lining, or the material of the inner lining may be inherently elastic in itself, in order to achieve the pinched waist effect.

Every pair of spectacles has a large recessed zone, being the zone which comprises the nose cut-out of the spectacles. When the inner lining has a pinched waist, the pinched waist is so arranged as to squeeze and grip the spectacles in the region of the nose cut-out. Thus, the grip can be tight and strong enough to grip the spectacles securely, and yet there is no forceful contact between the case and the vulnerable lenses of the spectacles. To be sure, the waist must be stretched over one of the lenses as the spectacles are inserted fully into the case, but so long as the material of the inner lining is soft and flexible, experience shows that scratching and other gradual damage to the lenses can be substantially eliminated.

Also, in the invention, the outer cover of the case is not required to be stretchy or pliable to anything like the extent that was required in a conventional spectacle case, where the cover was responsible for such gripping action as was provided by the case. Thus, in the invention, the outer cover can be designed and specified solely according to its primary function, which is to provide good physical protection for the spectacles.

Equally, the inner lining also may be designed and specified solely according to its primary function, which is to provide the correct grip on the spectacles; tight enough to prevent the spectacles from falling out of the case, yet not so tight that a person would have difficulty inserting or extracting the spectacles. In the invention, the performance of the spectacle case may be perfectly adequate even though the outer cover may be completely clear of the spectacles, and even though the physical protection offered by the inner lining is zero.

The invention permits the right balance to be achieved between ease of insertion/removal and strength of retention grip, over a wide range of spectacle sizes.

THE PRIOR ART

Patent publications U.S. Pat. No. 2,650,700 (WOLF, 9/1953) and U.S. Pat. No. 2.866,539 (McCULLOCH, 12/1958) show spectacle cases which incorporate an inner lining. U.S. Pat. No. 2,455,079 (MERCER, 11/1948) shows a rigid outer cover, with a clip for gripping the spectacles at the nose cut-out zone. Other references of interest include: U.S. Pat. No. 1,158,170 (BRADLEY, 1915); U.S. Pat. No. 2,739,698 (BARATELLI, 3/1956); U.S. Pat. No. 2,762,499 (STEGEMAN, 9/1956); and U.S. Pat. No. 3,819,033 (HUEBER, 6/1974).

The essential feature of the invention is that the inner lining must be soft and flexible; that the lining must be secured to the cover top and bottom, and that the unsecured central portion of the lining must be free to float laterally. This feature is not shown in the prior art.

DETAILED DESCRIPTION OF PREFERRED EMBODIMENT

By way of further explanation of the invention, an exemplary embodiment of the invention will now be described with reference to the accompanying drawings, in which.

The spectacle case shown in the accompanying drawings and described below is an example which embodies the invention. It should be noted that the scope of the invention is defined by the accompanying claims, and not necessarily by specific features of exemplary embodiments.

The spectacle case 20 includes an outer cover 23, which is made from leatherette or the like, and has a thickness of about 1 mm. As such, the material of the cover 23 is of an inherently stiff character, although the material is capable of being bent, folded, stitched, etc.

The spectacle case 20 also includes an inner lining 25. The lining 25 is made from a soft fabric, such as thin cotton. The material of the inner lining 25 is characterized as having substantially no stiffness.

The inner lining 25 is provided with an elastic band 27. The band 27 is formed as a length of rubber, ie the band is not a continuous circle. The band 27 of rubber is stitched to the inner lining 25, as shown at 29. The length of the band 27 is less than the width of the inner lining 25, and the rubber is stretched across the full width of the lining 25 before being stitched in place. When the stretch of the band 27 is relaxed, the inner lining becomes pinched, as shown.

Figure 1:
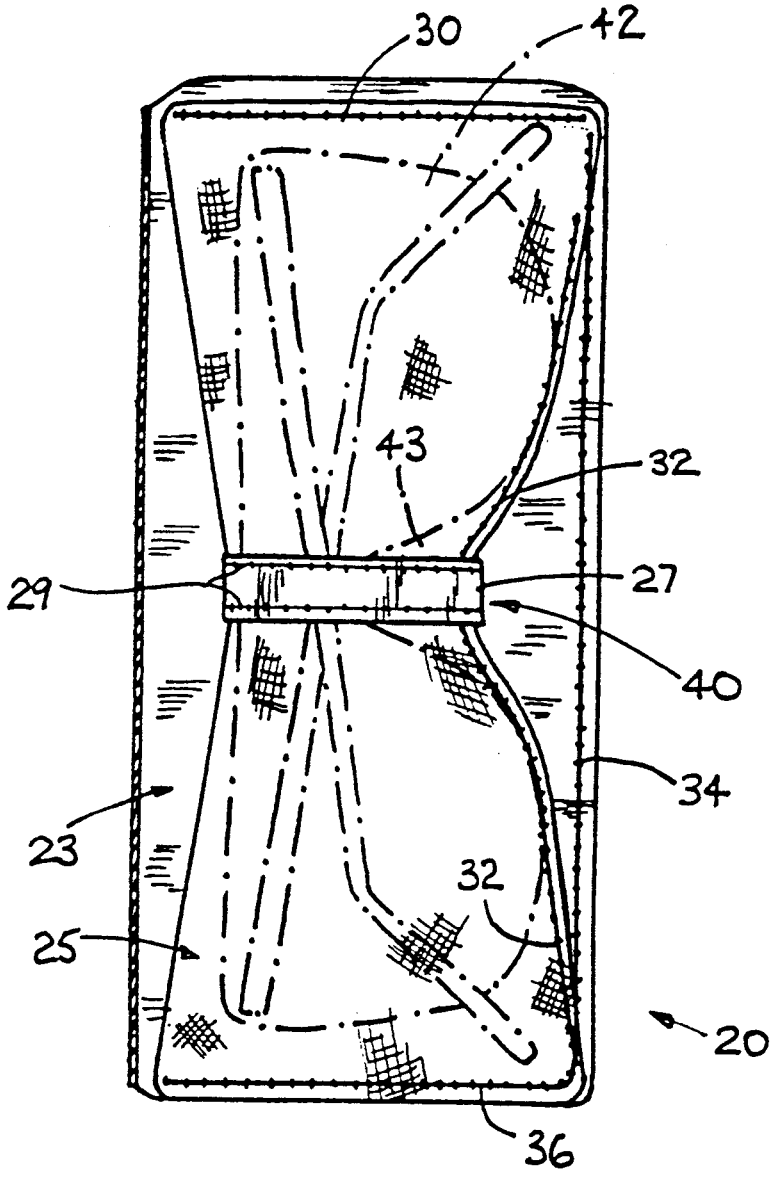
FIG. 1 is a view of a spectacle case, containing a pair of spectacles, which embodies the invention.
Figure 2:
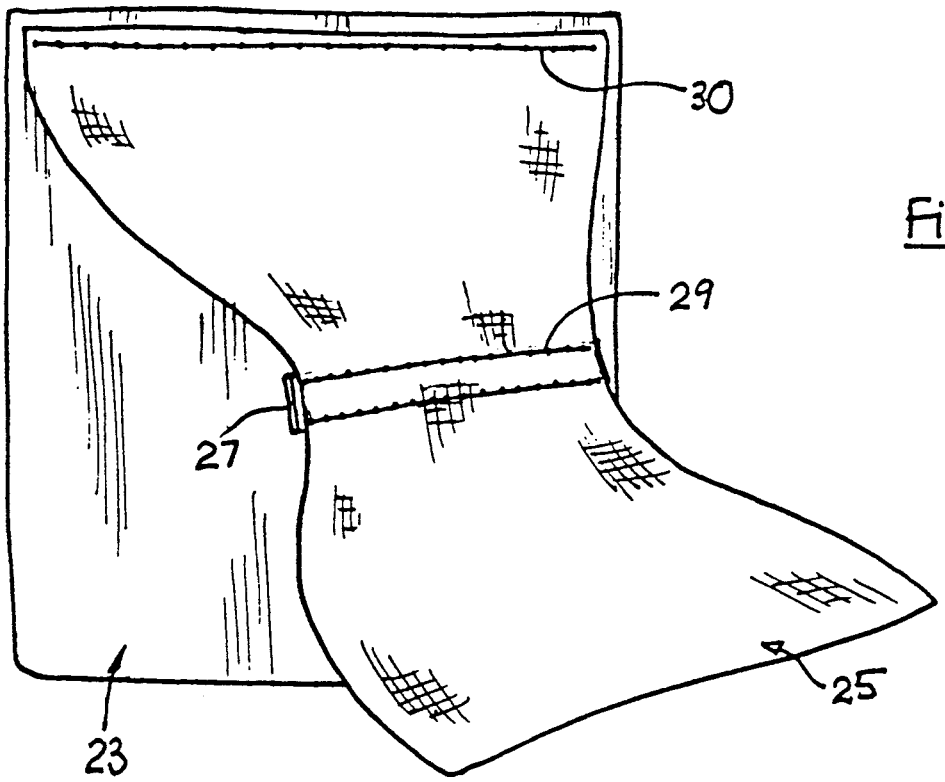
FIG. 2 is a view of some of the components of the spectacle case of FIG. 1, shown during a stage in the manufacture of the case.

FIG. 2 shows an initial stage of manufacture. The inner lining 25, with rubber band 27 attached, is stitched (as shown at 30) along its top edge to the top edge of the outer cover 23.

Figure 3:
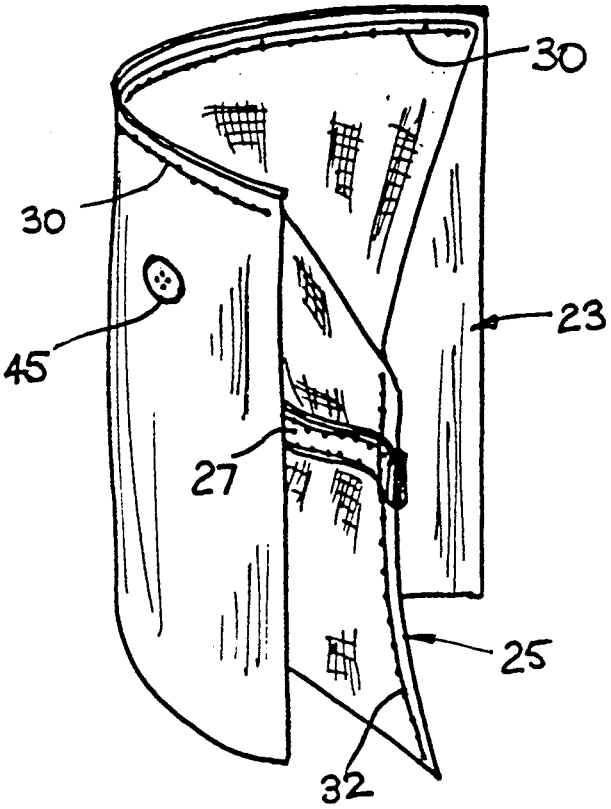
FIG. 3 is a view of the components shown in FIG. 2, shown at a later stage of manufacture.

As shown in FIG. 3, the left and right side edges of the inner lining 25 are brought together, and stitched together as shown at 32. The line of stitching 32 is arranged so as also to fasten together the ends of the elastic band 27. The line of stitching 32 may stop somewhat short of the line of stitching 30, as may be seen in FIG. 3, for ease of sewing.

The left and right side edges of the outer cover 23 are now brought together, and stitched together as shown at 34. The outer cover is also stitched across the bottom, as shown at 36, in order to close off the bottom of the cover. During the operation of inserting the lines of stitches 34 and 36, the inner lining 25 is arranged so that the bottom margin of the lining is caught by the line of stitching 36, but care is taken to ensure that the side edges of the lining, and the line of stitching 32, are not caught by the line of stitching 34. The small unstitched portion at the top of the side edges of the lining 25, however, is caught by the line of stitching 34.

The thin cotton inner lining 25 thus is stitched at top and bottom to the outer cover 23, but the inner lining 25 is loose, ie is not stitched to the outer cover, over the major central portion of the length of the cover. The elastic band 27 acts to create a pinched waist 40 in this loose central portion of the lining.

It will be noted that the loose central portion of the lining 25 is not secured laterally within the cover 23, and thus the pinched waist 40 is free to be displaced laterally with respect to the cover. The lining itself is, on the other hand, securely fixed top and bottom to the cover, with the result that the pinched waist 40 is constrained against movement in directions other than laterally.

The top edges of the outer cover 23 and the inner lining 25 form an open mouth of the spectacle case 20, into which a pair of spectacles 42 may be inserted. As the spectacles are being inserted, the pinched waist 40 of the lining 25 stretches over the entering spectacle lens; when the spectacles are fully inserted, the pinched waist 40 of the lining lies in the nose cut-out zone 43 of the spectacles.

As mentioned previously, it has been found that the strength of pinching that arises from the structure as described is such that the spectacles are held firmly and securely; a person may lean forwards, and engage in quite vigorous activity, confident in the knowledge that the spectacles will not fall out of the case.

Even though the spectacles are held in place securely and firmly, there is little forceful contact being made upon the actual lenses of the spectacles. Thus, it can be expected that the storage of the spectacles within the case as described will lead to a substantial reduction in the amount of gradual scratching and dulling of the lenses that was sometimes associated with the conventional cases. In the invention, the spectacles are gripped over the nose cut-out zone 43, not over the lenses.

The material of the inner lining 25 should be snag-resistant because spectacles often include screws and other small protruberances. The material therefore should be of a smooth, close woven or knitted nature.

The material of the inner lining 25 may itself be elastic. If so, the inner lining may be so stitched in place as to form a waist naturally, and therefore the provision of the elastic band 26, so as to form the pinched waist, is not essential to the invention. What is essential, in the invention, is that the central portion of the inner lining be freely expandable laterally, and preferably that the central portion be so arranged as to apply a pinching action to the nose cut-out zone of the spectacles.

In the region of the open mouth of the case, the material that forms the inner lining is shown as being stitched directly, ie flat against, the material of the outer cover. The material of the inner lining may alternatively be folded over to form a hem, if desired. Also, other methods of securement, besides stitching, may be employed: for example, the use of adhesives.

A button 45 is included for attaching the case to a shirt pocket. It is preferred that some means (though not necessarily a button) for securing the case to the clothing be provided. A friction-grip clip of conventional type may replace the button, as required. In fact, even if the case of the invention were not secured to the pocket, ie if the case were permitted to fall out of the pocket, it would still be still a useful advantage to retain the spectacles firmly in the case, as is made possible in the invention, in order to keep the spectacles safe if the case should fall.

The spectacles case of the invention finds particular application for such persons as tool setters, auto mechanics, etc, where the person is changing incessantly from close-up to distant vision, and consequently where there is a need for the case to permit rapid removal and insertion of the spectacles, and yet where there is an overriding need for the spectacles to be retained more securely than has been possible with the conventional spectacle cases.

With the case of the invention, the person quickly develops the technique of removing the spectacles from the face, folding them, and inserting them into the case, all in a single motion of the one hand. Similarly, the person can extract the spectacles from the case, unfold them, and place them on the face, as a single-hand operation.

I claim:

1. Spectacle case, wherein:

the case includes an outer cover and an inner lining;

the outer cover is of relatively thick and rigid material;

the inner lining is of relatively thin material, having substantially no stiffness;

the outer cover is so shaped and arranged as to be in the form of a tube, which is closed at a bottom portion of the tube, and open so as to form a mouth for receiving spectacles at an opposite, top, portion of the tube;

the inner lining is so shaped and arranged as to be in the form of a tube, which is closed at a bottom portion of the tube, and open so as to form a mouth for receiving spectacles at an opposite, top, portion of the tube;

the top portion of the inner lining is secured to the top portion of the outer cover;

the bottom portion of the inner lining is secured to the bottom portion of the outer cover;

and a centre portion of the inner lining, located between the said top and bottom portions, is substantially not secured to the outer cover, but is loose and free to move laterally with respect to the outer cover.

2. Case of claim 1, wherein the centre portion is resiliently expandable, whereby spectacles, upon insertion into the case, can be forced through the centre portion as a result of stretching action by the centre portion, and the centre portion is so located and arranged that, when the spectacles have been so inserted, the centre portion exerts a resilient grip around and upon a nose cut-out zone of the spectacles.

3. Case of claim 2, wherein the centre portion of the lining is provided with a band of elastomeric material, which is so positioned and arranged upon the lining as to create a pinched waist in the centre portion of the inner lining.

4. Case of claim 1, wherein the case includes a means for securing the case to a shirt pocket or the like.

* * * * *